US007019585B1

(12) United States Patent
Wilson et al.

(10) Patent No.: US 7,019,585 B1
(45) Date of Patent: Mar. 28, 2006

(54) METHOD AND CIRCUIT FOR ADJUSTING A REFERENCE VOLTAGE SIGNAL

(75) Inventors: Adam B. Wilson, Colchester, VT (US); Ryan Jurasek, Burlington, VT (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 10/808,883

(22) Filed: Mar. 24, 2004

Related U.S. Application Data

(60) Provisional application No. 60/457,799, filed on Mar. 25, 2003.

(51) Int. Cl.
*G05F 1/10* (2006.01)
*G05F 3/02* (2006.01)

(52) U.S. Cl. ..... 327/541; 327/543

(58) Field of Classification Search ..... 327/538, 327/540–541, 543; 323/316
See application file for complete search history.

(56) References Cited

U.S. PATENT DOCUMENTS 5,216,385 A 6/1993 McDaniel ..... 330/282
5,218,364 A 6/1993 Kumazawa et al. ..... 341/136
6,147,908 A 11/2000 Abugharbieh et al. ... 365/185.2
6,275,090 B1 * 8/2001 Burger et al. ..... 327/334
6,281,734 B1 8/2001 McClure et al. ..... 327/308
6,329,804 B1 12/2001 Mercer ..... 323/315
6,476,669 B1 11/2002 McClure et al. ..... 327/543
6,542,026 B1 * 4/2003 Wu et al. ..... 327/540
6,737,909 B1 * 5/2004 Jaussi et al. ..... 327/541
2003/0197634 A1 * 10/2003 Otani et al. ..... 341/144

FOREIGN PATENT DOCUMENTS

JP 2000049283 A * 2/2000

* cited by examiner

*Primary Examiner*—Quan Tra

(57) ABSTRACT

A voltage trim circuit, in accordance with one embodiment of the invention, includes an operational amplifier, a transistor, a voltage divider and a bias current circuit. The operational amplifier is coupled to an input. The transistor is coupled to the operational amplifier and a first potential. The voltage divider circuit is coupled to the operational amplifier, the transistor and an output. The bias current circuit is coupled to the voltage divider circuit and a second potential. The voltage divider generates an output voltage as a function of a selectable divider ratio and provides a substantially constant feedback path to the operational amplifier. The bias current circuit provides for selectively adjusting a load resistance of the transistor to maintain a substantially constant load current through the transistor.

19 Claims, 4 Drawing Sheets

METHOD AND CIRCUIT FOR ADJUSTING A REFERENCE VOLTAGE SIGNAL

CROSS-REFERENCE TO RELATED APPLICATION

This application claims the benefit of U.S. Provisional Application No. 60/457,799 filed Mar. 25, 2003 entitled "Method and Apparatus for Adjusting a Reference Voltage", by Wilson et al. The provisional application is incorporated herein by reference in its entirety.

BACKGROUND OF THE INVENTION

In the conventional art, circuit operation in integrated circuits often depends upon one or more accurate and stable voltage references. For example, numerous analog circuits, such as amplifiers, current mirrors and the like depend upon current sources that conduct stable currents. The accuracy and stability of the current sources typically depend upon the accuracy and stability of one or more reference voltages applied to the gates of transistors that provide the current sources. Other circuits, particularly those that control the switching response of digital circuits depend upon the accuracy and stability of the reference voltages to control the switching speeds, slew rates and/or the like of the circuit.

Even a relatively process/voltage/temperature (PVT) insensitive voltage reference exhibits some variations from a desired voltage. For example, a reference circuit for generating 3V may exhibit a ±60 mV variance over all PVT variations. Accordingly, adjustment of the voltage reference value may sometimes be required to compensate for fabrication process variations, voltage variations and/or temperature variations.

Referring to FIG. 1, a block diagram of a voltage trim circuit 100, in accordance with the conventional art, is shown. The input reference voltage $V_{IN}$ may be generated by a bandgap type reference circuit or other similar PVT insensitive reference circuit. The operational amplifier 105 compares the input reference voltage ($V_{IN}$) with the feedback voltage ($V_{FB}$), and depending upon the state of the switches 130–145 and the resistive values 115–125, can adjust the output reference voltage ($V_{OUT}$) above or below the input reference voltage ($V_{IN}$). Another voltage trim circuit is disclosed in McClure et al., U.S. Pat. No. 6,281,734 issued Aug. 28, 2001.

The conventional voltage trim circuits allow for correction of PVT induced reference voltage variations. However, the conventional voltage trim circuits may exhibit instability. Therefore, there is a continued need for an improved voltage trim circuit.

SUMMARY OF THE INVENTION

Embodiments of the present invention are directed toward an improved voltage trim circuit. In one embodiment, a voltage trim circuit includes an operational amplifier, a transistor, a voltage divider and a bias current circuit. The operational amplifier is operable to receive an input. The transistor is coupled to the operational amplifier and a first potential. The voltage divider circuit is coupled to the operational amplifier, the transistor and an output. The bias current circuit is coupled to the voltage divider circuit and a second potential. In one embodiment, the voltage divider generates an output voltage as a function of a selectable divider ratio and provides a substantially constant feedback path to the operational amplifier. The bias current circuit provides for selectively adjusting the load resistance of the transistor to maintain a substantially constant load current through the transistor.

In another embodiment, a method of trimming a voltage signal includes receiving an input voltage, performing a constant load current and constant feedback impedance voltage trim process and outputting the trimmed voltage. When the input reference voltage ($V_{IN}$) is low, an appropriate selector element may be configured to couple a particular trim-up voltage (e.g., desired voltage) to the output ($V_{OUT}$). Furthermore, an appropriate shunt element may be configured to keep the load current through the transistor substantially constant, thereby keeping the DC operating point of the transistor constant. Conversely, when the input reference voltage ($V_{IN}$) is too high, an appropriate selector element may be configured to couple a particular trim-down voltage to the output ($V_{OUT}$). Likewise, an appropriate shunt element may be configured to keep the load current substantially constant. The selector elements and shunt elements may be configured while a substantially constant feedback impedance is maintained.

Advantageously, embodiments of the present invention maintain a substantially constant DC operating point of the transistor. Embodiments of the present invention also maintain a substantially constant feedback path to the operational amplifier. The substantially constant DC operating point of the transistor and the substantially constant feedback path to the operational amplifier improve the stability of the voltage trim circuit over all trim voltages.

Embodiments of the present invention may advantageously be utilized to trim an input reference voltage to a desired voltage, when the input reference voltage is outside of a designed range. Embodiments of the present invention may also advantageously be utilized to generate additional reference voltage levels.

DESCRIPTION OF THE DRAWINGS

The present invention is illustrated by way of example and not by way of limitation, in the figures of the accompanying drawings and in which like reference numerals refer to similar elements and in which.

DETAILED DESCRIPTION OF THE INVENTION

Reference will now be made in detail to the embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it is understood that the present invention may be practiced without these specific details. In other instances, well-known methods, procedures, components, and circuits have not been described in detail as not to unnecessarily obscure aspects of the present invention.

Figure 1:
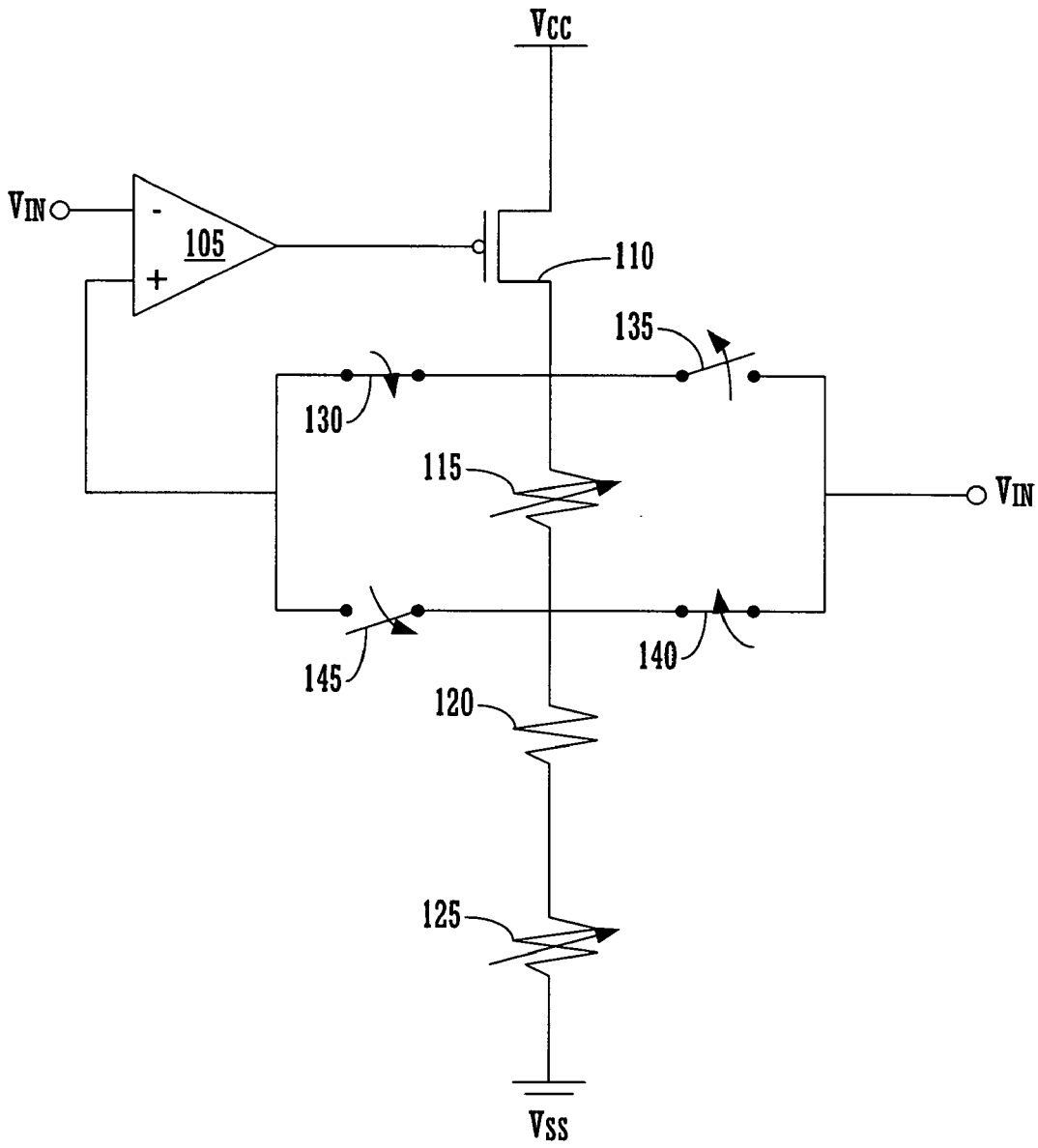
FIG. 1 shows a block diagram of a voltage trim circuit, in accordance with the conventional art.
Figure 2:
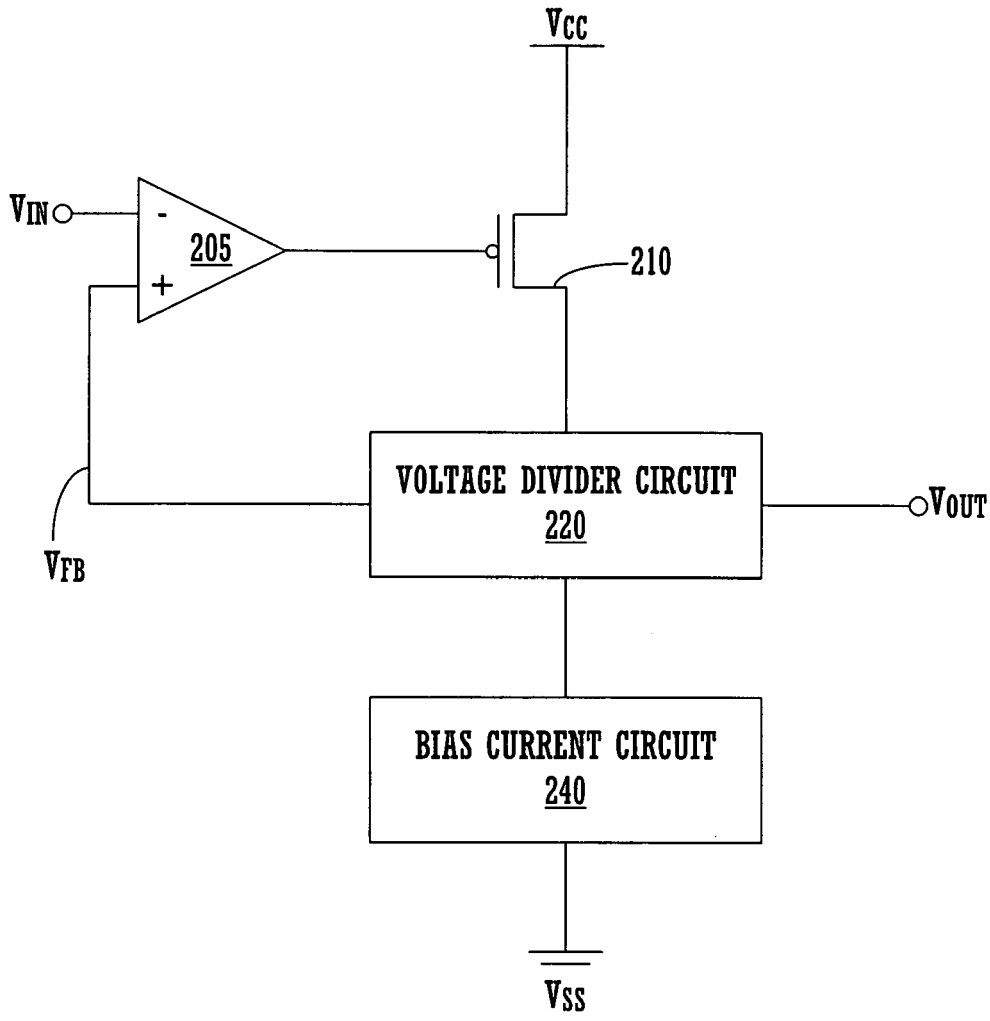
FIG. 2 shows a block diagram of a voltage trim circuit, according to one embodiment of the present invention.

Referring to FIG. 2, a block diagram of a voltage trim circuit 200, according to one embodiment of the present invention, is shown. As depicted in FIG. 2, the voltage trim circuit 200 includes an operational amplifier 205, a transistor 210, a voltage divider circuit 220 and a bias current circuit 240. The operational amplifier 205 includes an inverting input coupled to an input ($V_{IN}$), and a non-inverting input for receiving a feedback voltage ($V_{FB}$). The transistor 210 includes a source coupled to a first potential ($V_{CC}$) and a gate coupled to the output of the operational amplifier 205. The voltage divider circuit 220 includes a first terminal coupled to a drain of the transistor 210, a second terminal for generating the feedback voltage ($V_{FB}$), and a third terminal coupled to an output ($V_{OUT}$). The bias current circuit 240 includes a first terminal coupled to a fourth terminal of the voltage divider circuit 220 and a second terminal coupled to a second potential ($V_{SS}$).

The bias current circuit 240 provides an adjustable resistive load coupled to the transistor 210. The current drawn through the transistor 210 is a function of the feedback voltage level ($V_{FB}$) (e.g., input voltage ($V_{IN}$)) and the adjustable resistive load of the bias current circuit 240. Hence, the bias current circuit 240 may be configured to maintain a substantially constant load current through the transistor 210 by selectively increasing or decreasing the load resistance if the input voltage is below or above, respectively, a desired voltage level. The substantially constant load current provides a substantially constant direct current (DC) operating point of the transistor 210.

In addition, the voltage divider circuit 220 provides a substantially constant feedback path (e.g., resistance and capacitance) as seen by the non-inverting input of the operational amplifier 205. It is appreciated that resistors typically introduce stray capacitance, particularly when fabricated from polysilicon or doped silicon. Switching in and/or out resistance in the feedback path changes the time constant associated of the feedback path. The substantially constant impedance (e.g., resistance and capacitance) provided by the voltage divider circuit 220 results in a substantially constant delay in the feedback loop, keeping the phase margin high and thereby avoiding instability in the operational amplifier 205. The voltage divider circuit 220 also provides an adjustable divider ratio at its third terminal. The voltage divider circuit 220 may, therefore, be configured to provide a desired voltage level (e.g., trim the input voltage) by selecting an appropriate divider ratio.

Figure 3:
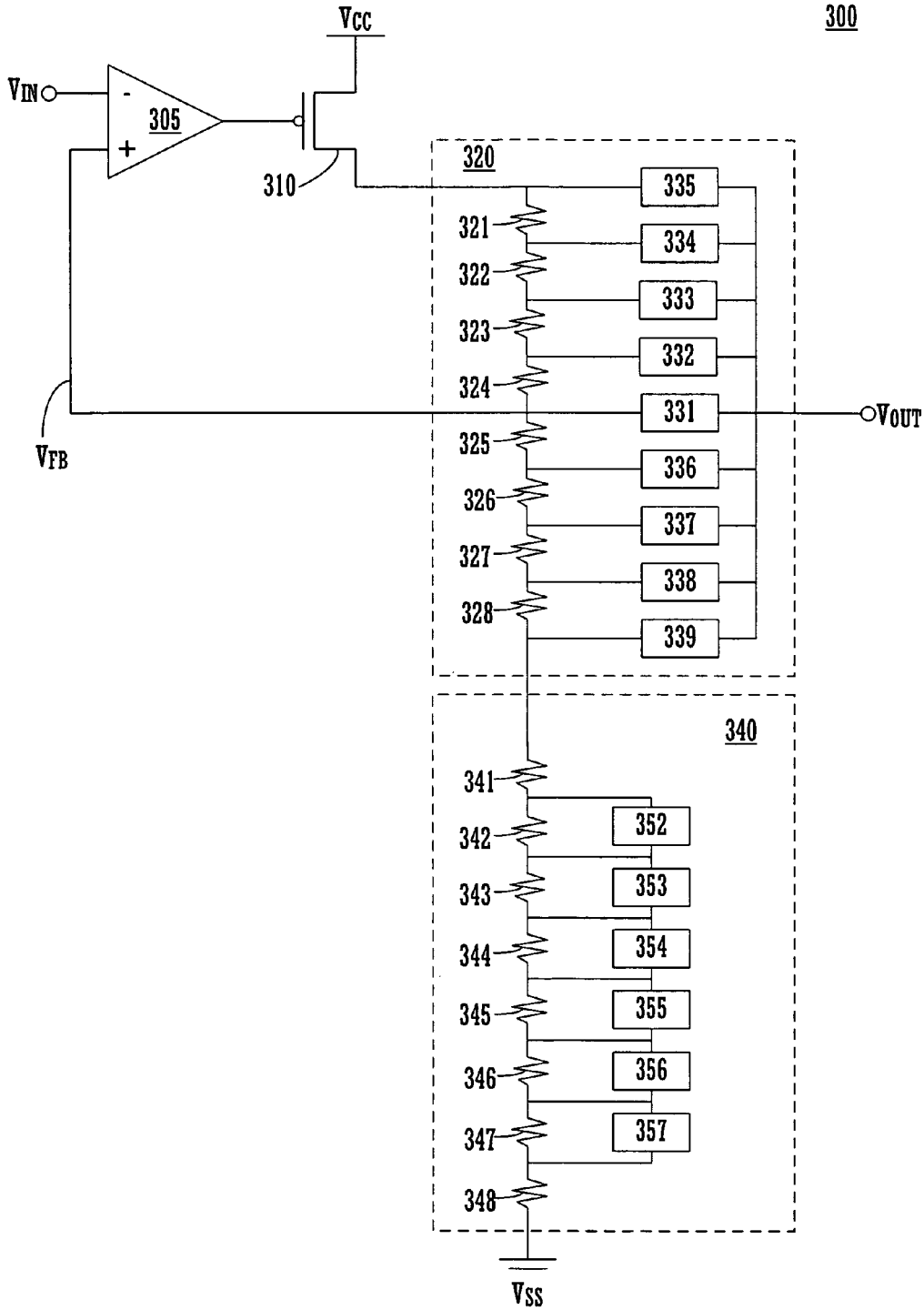
FIG. 3 shows circuit diagram of an exemplary voltage trim circuit, according to one embodiment of the present invention.

Referring now to FIG. 3, a circuit diagram of an exemplary voltage trim circuit 300, according to one embodiment of the present invention, is shown. As depicted in FIG. 3, the voltage trim circuit 300 includes an operational amplifier 305, a transistor 310, a voltage divider circuit 320 and a bias current circuit 340. The operational amplifier 305 includes an inverting input for receiving an input voltage ($V_{IN}$). The transistor 310 includes a source coupled to a supply ($V_{CC}$) and a gate coupled to an output of the operational amplifier 305. The voltage divider circuit 320 includes a first terminal coupled to a drain of the transistor 310, a second terminal coupled to a non-inverting input of the operational amplifier 305 and a third terminal for providing a selectable output voltage ($V_{OUT}$). The bias current circuit 340 includes a first terminal coupled to a fourth terminal of the voltage divider circuit 320 and a second terminal coupled to ground ($V_{SS}$).

The voltage divider circuit 320 includes a first plurality of resistors 321–328 coupled in series. In one implementation, the resistive value of each of the first plurality of resistors 321–328 are substantially equal. A node (e.g., feedback node) between a first set 321–324 and a second set 325–328 of the series resistor circuit 321–328 is coupled to the non-inverting input of the operational amplifier 305. The operational amplifier 305 generates a drive voltage at the gate of the transistor 310.

The drive voltage is a function of a voltage difference between the inverting and non-inverting inputs. The drive voltage will cause the transistor 310 to conduct current such that the voltage present at the feedback node (e.g., $V_{FB}$) is substantially equal to the input voltage ($V_{IN}$). Hence, the drive voltage generated by the operational amplifier 305 will be maintained at a level that will result in the voltage at the non-inverting input being substantially equal to the voltage at the inverting input of the operational amplifier 305 (e.g., input voltage ($V_{IN}$).

The bias current circuit 340 includes a second plurality of resistors 341–348 coupled in series. The series resistor circuit 321–328 of the voltage divider circuit 320 and the series resistor circuit 341–348 of the current bias circuit 340 are coupled in series to form a load resistance of the transistor 310. In one implementation, the second plurality of resistors, of the bias current circuit 340, may be grouped functionally in a first set 342–344, a second set 345–347 and a third set 341 and 348. The first set 342–344 and second set 345–347 of resistors each provide a group of binary weighted resistances. The bias current circuit 340 further includes a plurality of shunt elements 352–357. Each shunt element 352–357 is coupled in parallel with a respective one of the first and second set of resistors 342–347. The shunt element may be a switch, a transistor, a fuse and/or the like. The shunt elements 352–357 may be configurable to selectively increase and decrease the series resistance provided by the bias current circuit 340. The load current through the transistor 310 will be a function of the feedback voltage ($V_{FB}$) and the series resistance provided by the bias current circuit 340. Hence, the load resistance may be selectively increased and decreased such that a substantially constant load current through the transistor 310 is maintained when the input voltage ($V_{IN}$) (e.g., feedback voltage) is below or above, respectively, a desired voltage level.

The voltage divider circuit 320 further includes a plurality of selector elements 331–339. Each selector element 331–339 may be configurable to selectively couple a given node of the series resistor circuit 321–329, of the voltage divider circuit 320, to the output. In addition, the first set of the plurality of resistors 321–325, of the voltage divider circuit 320, provide a substantially constant feedback path (e.g., resistance and capacitance) as seen by the non-inverting input of the operational amplifier 305. The substantially constant resistance and capacitance of the feedback loop provides for stable operation of the operational amplifier 305.

With reference to FIG. 3, the design and operation of the voltage trim circuit 300 may further be described with reference to the following exemplary implementations. The parameters of the exemplary implementations are for illustrative purposes only, and are not intended to limit the scope of the invention as defined by the claims. In one implementation, the input voltage ($V_{IN}$) is 3V±40 mV, $V_{CC}$ is 5V, $V_{SS}$ is 0V, the load current through the transistor ($I_{SD}$) is 0.1 mA and a 10 mV trim voltage increment is desired. The voltage divider circuit includes eight resistors 321–328 connected in series. The bias current circuit also includes eight resistor connected in series. Six resistors 342–347, of the bias current circuit provide two sets of binary weighted resistances.

If the input voltage, and hence the feedback voltage, is 1.5 V and the load current is 0.1 mA, then the load resistance should be 15 KΩ. The resistive values of the voltage divider circuit are selected such that the load current (e.g., 0.1 mA) provides the desired voltage increment (e.g., 10 mV) across each resistor in the voltage divider circuit. Hence, the resistors 321–328 of the voltage divider circuit may be 100 Ω each. If the input voltage, and hence the reference voltage, is 1.49V (e.g., 10 mV low) then the load resistance should be reduced to 14.9 KΩ to maintain a substantially constant load current. Therefore, resistor 344, of the bias current circuit, may be 100 Ω. Similarly, the resistor 345 may be 100 Ω. If the input voltage, and hence the reference voltage, is 20 mV low or high the load resistance should be reduced to 14.8K or increased to 15.2K, accordingly, to maintain a substantially constant load current. Therefore, resistors 343, 346 may be 200 Ω each. Similarly, the resistors 342, 347 may be 400 Ω each. In the non-trim state resistors 345–347 are shunted and resistors 342–344 are not shunted. The voltage divider circuit provides a series resistance of 800 Ω, and the bias current circuit provides a series resistance of 700 Ω. Thus, the sum of the resistance provided by the additional resistors 341, 348, of the bias current circuit, should be 13.5 KΩ.

In another exemplary implementation the input voltage is 3V±400 mV, VCC is 10V, VSS is 0V, the current through the transistor is 0.01 mA and a 100 mV trim voltage increment is desired. Accordingly, the load resistance may be 300 KΩ. The resistors 321–328 of the voltage divider circuit may be 10 KΩ each. The resistors 344, 345 of the bias current circuit may be 10 KΩ each; the resistors 343, 346 may be 20 KΩ each; and the resistors 342, 347 may be 40 KΩ each. The sum of the resistance provided by the additional resistors 341, 348, of the bias current circuit, may be 150 KΩ.

Operation of the exemplary voltage trim circuit 300, according to the second above-described implementation, is summarized in Table 1.

TABLE 1

| $V_{OUT}$ TRIM | 0 mV | +100 mV | +200 mV | +300 mV | +400 mV | −100 mV | −200 mV | −300 mV | −400 mV |
|---|---|---|---|---|---|---|---|---|---|
| 331 | 1 | 0 | 0 | 0 | 0 | 0 | 0 | 0 | 0 |
| 332 | 0 | 1 | 0 | 0 | 0 | 0 | 0 | 0 | 0 |
| 333 | 0 | 0 | 1 | 0 | 0 | 0 | 0 | 0 | 0 |
| 334 | 0 | 0 | 0 | 1 | 0 | 0 | 0 | 0 | 0 |
| 335 | 0 | 0 | 0 | 0 | 1 | 0 | 0 | 0 | 0 |
| 336 | 0 | 0 | 0 | 0 | 0 | 1 | 0 | 0 | 0 |
| 337 | 0 | 0 | 0 | 0 | 0 | 0 | 1 | 0 | 0 |
| 338 | 0 | 0 | 0 | 0 | 0 | 0 | 0 | 1 | 0 |
| 339 | 0 | 0 | 0 | 0 | 0 | 0 | 0 | 0 | 1 |
| 352 | 0 | 0 | 0 | 0 | 1 | 0 | 0 | 0 | 0 |
| 353 | 0 | 0 | 1 | 1 | 0 | 0 | 0 | 0 | 0 |
| 354 | 0 | 1 | 0 | 1 | 0 | 0 | 0 | 0 | 0 |
| 355 | 1 | 1 | 1 | 1 | 1 | 0 | 1 | 0 | 1 |
| 356 | 1 | 1 | 1 | 1 | 1 | 1 | 0 | 0 | 1 |
| 357 | 1 | 1 | 1 | 1 | 1 | 1 | 1 | 1 | 0 |

Each column of the table specifies, for a given trim level, the appropriate configuration of the selector elements 331–339 and the shunt elements 352–357. For example, to trim the output voltage up 100 mV, relative to the input voltage, the second selector element 332 should be configured to couple the node between resistors 324 and 323 to the output. Furthermore, shunt elements 354–357 should be configured to shunt resistors 344–347. To trim the input voltage down 400 mV, the ninth selector element 339 should be configured to couple the node between resistor 328 and 341 to the output. Furthermore, resistors 342–344 and 347 should not be shunted by shunt elements 352–354 and 357.

Embodiments of the present invention have been described wherein the bias current circuit 340 includes a first and second set of binary weighted resistors utilized to maintain a substantially constant load current. However, it is appreciated that non-binary weighted resistors may also be utilized. For example, the exemplary voltage trim circuit shown in FIG. 3 may include a first set of four substantially equal resistors, a second set of four substantially equal resistors and eight corresponding shunting elements.

The exemplary voltage trim circuit 300, shown in FIG. 3, illustrates an implementation that provides four trim-up voltages and four trim-down voltage. However, it is appreciated that embodiments of the present invention may also implement more or less trim voltage levels. For example, one trim-up and one trim-down voltage may be implemented with a voltage divider circuit that includes two resistors and three selector elements. In such an implementation, the bias current circuit would include two shuntable resistors. In another example, seven trim-up and seven trim-down voltages may be provided utilizing the same bias current circuit as shown in FIG. 3. The same bias current circuit may be utilized because the binary weighted shuntable resistors may be configured to selectively provide fifteen different load resistances. In such an implementation, an additional six resistors and six selector elements, three for trimming up and three for trimming down, would be added to the voltage divider circuit. In yet another embodiment, addition of two more binary weighted shuntable resistances to the bias current circuit, and twenty resistors and selector elements to the voltage divider circuit will provide for thirty trim voltage levels.

The selector elements and shunt elements may be implemented by any well-known in the art method, such as fuses, switches, transistors, logic circuits, test mode circuits and/or the like. In one implementation, for example, the selector elements and shunt elements may be fuses. In a non-trim mode, selector element 331 is unblown, selector elements 332–339 are blown, shunt elements 352–354 are blown and shunt elements 355–357 are unblown. In a first trim-up mode, selector element 332 is unblown, selector elements 331 and 333–339 are blown, shunt elements 352 and 353 are blown and shunt elements 354–337 are unblown. In another implementation, the selector elements and shunt elements may be switch mode MOSFETs, wherein the "on" and "off" states of the MOSFETs are a function of the content of a register. The register may include a bit corresponding to each MOSFET. Alternatively, the register may be loaded with a binary code for controlling the state of the MOSFETs. The binary code is decoded by a logic circuit to provide the appropriate gate voltage to each MOSFET. It is appreciated that elements such as fuses may be utilized to provide a static configuration of the voltage trim circuit. The use of circuits such as switch mode MOSFETs and a register may be utilized to provide dynamic configuration of the voltage trim circuit. Furthermore, the combination of elements, such as fuses, and circuits, such as switch mode MOSFETs, may be combined (e.g., test mode implementations) to provide a hybrid dynamic/static configuration of the voltage trim circuit.

Figure 4:
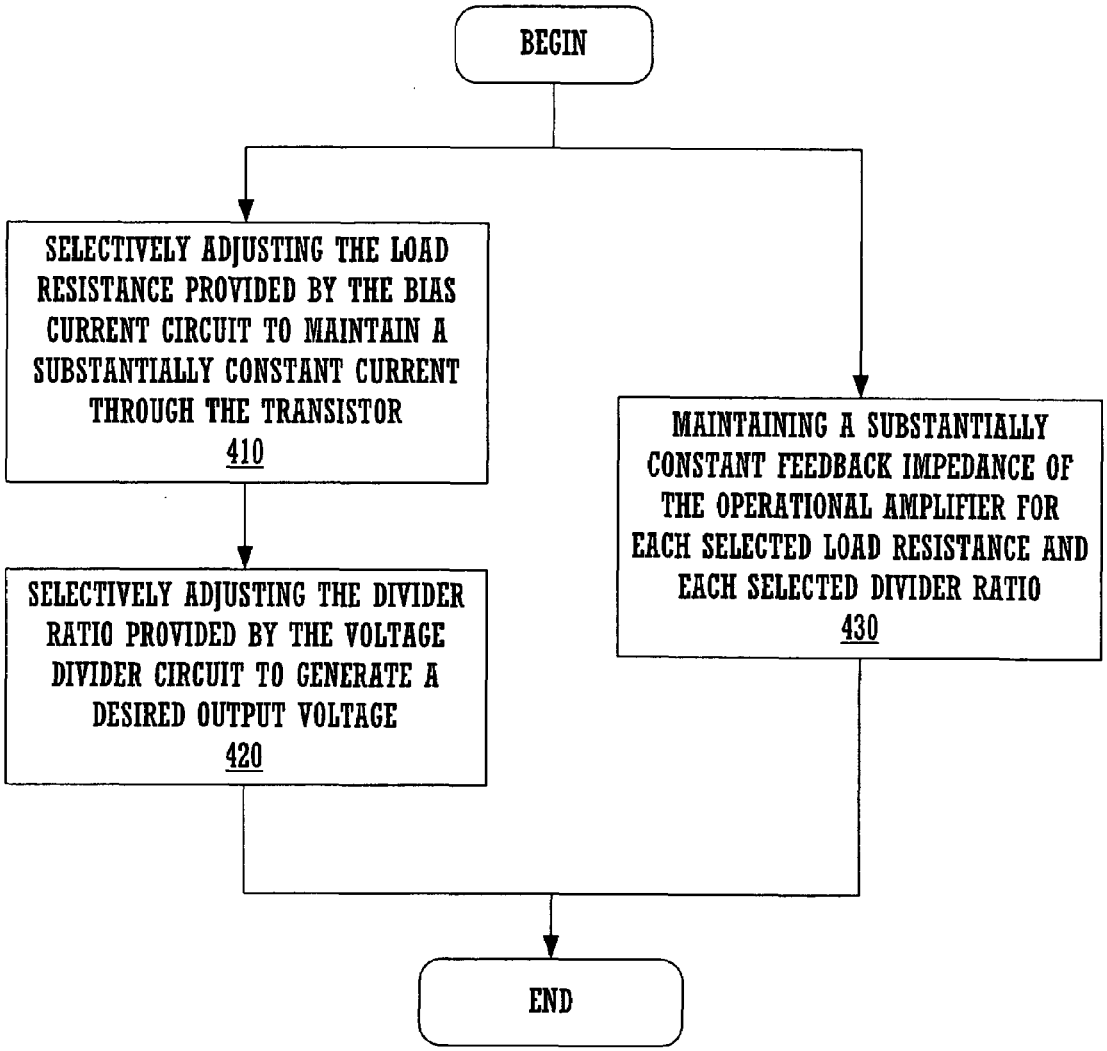
FIG. 4 shows a flow diagram of a method of trimming an input voltage signal, in accordance with one embodiment of the present invention.

Referring now to FIG. 4, a flow diagram of a method of trimming an input voltage signal, in accordance with one embodiment of the present invention, is shown. The voltage trim circuit includes an operational amplifier, a transistor, a voltage divider circuit, and a bias current circuit. As depicted in FIG. 4, the method includes selectively adjusting a load resistance provided by the bias current circuit to maintain a substantially constant load current through the transistor, at 410. The method also includes selectively adjusting the divider ratio provided by the voltage divider circuit to generate a desired output voltage, at 420. The method also includes maintaining a substantially constant feedback impedance of the operational amplifier for each selected load resistance and each selected divider ratio, at 430.

For example, at 410, a first set of the binary weighted resistors, of the bias circuit, are shunted by corresponding shunting elements. A second set of binary weighted resistors are not shunted, in a non-trim state. At 420, the feedback voltage (e.g., input voltage) is selectively coupled to the output by a first selector element. A substantially constant feedback impedance, as seen by the operational amplifier, is maintained at 430 while processes 410 and 420 are performed.

In a first trim-up state the input voltage (VIN) is less than the desired voltage by a first amount. Therefore, the first set of binary weighted resistors, of the bias circuit, and a first resistor of the second set of binary weighted resistors are shunted, at 410. The voltage at a second node is selectively coupled to the output by a second selector element, at 420. In addition, a substantially constant feedback impedance is maintained at 430, while processes 410 and 420 are performed.

In a second trim-up state, the input voltage (VIN) is less than the desired voltage by a second amount. Therefore, the first set of binary weighted resistors and a second resistor of the second set of binary weighted resistors are shunted, at 410. The voltage at a third node is selectively coupled to the output by a third selector element, at 420. In addition, a substantially constant feedback impedance is maintained at 430, while processes 410 and 420 are performed.

It is appreciated that processes 410 and 420 may be performed in parallel or serially. The process of 430 may performed in parallel with both processes 410 and 420. Thus, the trim process is characterized by a constant load current and constant feedback impedance voltage trim process.

Embodiments of the present invention may advantageously be utilized to trim the input reference voltage to a desired voltage, when the input reference voltage is outside of a designed range. Embodiments of the present invention may also advantageously be utilized to generate one or more additional reference voltage levels.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A voltage trim circuit comprising:

an operational amplifier coupled to an input node;

a transistor coupled to said operational amplifier and for receiving a first potential;

a voltage divider circuit coupled to said operational amplifier, said transistor and an output, wherein an output voltage is generated as a function of an adjustable divider ratio, and wherein a substantially constant feedback path is provided to said operational amplifier; and a bias current circuit coupled to said voltage divider circuit and a second potential, wherein an adjustable resistive load is configurable to maintain a substantially constant load current through said transistor.

2. The voltage trim circuit according to claim 1, wherein said input node is coupled to an inverting input of said operational amplifier;

said output of said operational amplifier is coupled to a gate of said transistor;

said first potential is coupled to a source of said transistor;

a drain of said transistor is coupled to a first terminal of said voltage divider;

a second terminal of said voltage divider circuit is coupled to a non-inverting input of said operational amplifier;

a third terminal of said voltage divider circuit is coupled to said output a fourth terminal of said voltage divider circuit is coupled to a first terminal of said bias current circuit; and a second terminal of said bias current circuit is coupled to said second potential.

3. The voltage trim circuit according to claim 1, wherein said voltage divider circuit comprises:

a series resistor circuit coupled between said transistor and said bias current circuit; and a plurality of selector elements, wherein each selector element is coupled between a corresponding node of said series resistor circuit and said output.

4. The voltage trim circuit according to claim 1, wherein said bias current circuit comprises:

a series resistor circuit coupled between said voltage divider circuit and said second potential; and a plurality of shunt elements, wherein each shunt element is coupled in parallel with a corresponding one of a first portion of resistors of said series resistor circuit.

5. The voltage trim circuit according to claim 4, wherein said first portion of said series resistor circuit comprises:

a first set of binary weighted resistors; and a second set of binary weighted resistors.

6. The voltage trim circuit according to claim 1, wherein said substantially constant load current is adapted to reduce instability in said voltage trim circuit.

7. The voltage trim circuit according to claim 1, wherein said substantially constant feedback path is adapted to reduce instability in said voltage trim circuit.

8. A method of trimming a voltage comprising:

receiving an input voltage to be trimmed;

performing a constant load current and constant feedback impedance voltage trim process on said input voltage, said process comprising:

selectively adjusting a load resistance wherein a substantially constant load current is maintained;

selectively adjusting a divider ratio wherein a desired output voltage is generated; and maintaining a substantially constant feedback impedance for each selected load resistance; and outputting a trimmed voltage from said input voltage.

9. The method according to claim 8, wherein said selectively adjusting said load resistance comprises selectively shunting one or more resistors of a bias current circuit.

10. The method according to claim 8, wherein said selectively adjusting said divider ratio comprises selectively coupling an appropriate one of a plurality of nodes of a voltage divider circuit to an output.

11. The voltage trim circuit according to claim 8, wherein said maintaining said substantially constant feedback impedance comprises fixedly coupling a particular node of a voltage divider circuit to an input of an operational amplifier.

12. A system of generating a desired output voltage from an input voltage utilizing a voltage trim circuit comprising:

an operational amplifier;

a transistor coupled to said operational amplifier;

a voltage divider coupled to said transistor and said operational amplifier and for selectively adjusting a divider ratio to generate said desired output voltage and for maintaining a substantially constant feedback impedance over a range of input voltage levels; and a bias current circuit coupled to said voltage divider circuit and for selectively adjusting a resistance to maintain a substantially constant load current over said range of input voltage levels.

13. The system according to claim 12, wherein said substantially constant load current flows through said transistor.

14. The system according to claim 12, wherein said substantially constant load current and said substantially constant feedback impedance are adapted to reduce instability in said voltage trim circuit.

15. The system according to claim 12, wherein said voltage divider circuit comprises:

a first plurality of resistors coupled in series; and a plurality of selector elements, wherein each selector element is coupled between a corresponding node of said first plurality of resistor coupled in series and an output.

16. The system according to claim 15, wherein each of said first plurality of resistors have substantially equal resistance.

17. The system according to claim 12, wherein said bias current circuit comprises:

a second plurality of resistors coupled in series; and a plurality of shunt elements, wherein each shunt element is coupled in parallel with one of said second plurality of resistors.

18. The system according to claim 17, wherein said second plurality of resistors comprise:

a first set of binary weighted resistances; and a second set of binary weighted resistances.

19. The system according to claim 17 wherein said bias current circuit further comprises an additional resistor coupled in series with said second plurality of resistors.

* * * * *